US005433318A

United States Patent [19]

Focke

[11] Patent Number: 5,433,318

[45] Date of Patent: Jul. 18, 1995

[54] HINGE-LID PACK FOR STICK-SHAPED ARTICLES, ESPECIALLY CIGARETTES

[75] Inventor: Heinz Focke, Verden, Germany

[73] Assignee: Focke & Co. (GmbH & Co.), Verden, Germany

[21] Appl. No.: 220,930

[22] Filed: Mar. 31, 1994

[30] Foreign Application Priority Data

Apr. 5, 1993 [DE] Germany ..... 43 10 800.8

[51] Int. Cl.[6] ..... B65D 85/10

[52] U.S. Cl. ..... 206/256; 206/257; 206/264

[58] Field of Search ..... 206/256, 257, 258, 264, 206/268, 271, 273; 229/120.22, 120.25, 120.38, 160.1

[56] References Cited

U.S. PATENT DOCUMENTS

| | | | |
|---|---|---|---|
| 209,156 | 10/1878 | Bovee . | |
| 1,253,219 | 1/1918 | Dula . | |
| 2,006,591 | 7/1935 | Fox . | |
| 2,563,132 | 8/1951 | Paige | 229/120.38 |
| 2,820,545 | 1/1958 | Bramhill . | |
| 3,159,272 | 12/1964 | Swift . | |
| 4,793,478 | 12/1988 | Tudor . | |
| 5,129,513 | 7/1992 | David et al. . | |

FOREIGN PATENT DOCUMENTS

| | | | |
|---|---|---|---|
| 859201 | 12/1940 | France | 206/258 |
| 577933 | 6/1933 | Germany . | |
| 651226 | 3/1935 | Germany . | |
| 822374 | 10/1951 | Germany . | |
| 38183 | 4/1965 | Germany . | |
| 7024850 | 7/1970 | Germany . | |
| 2148563 | 4/1972 | Germany . | |
| 4200719 | 8/1992 | Germany . | |
| 201465 | 3/1939 | Switzerland . | |
| 209124 | 6/1940 | Switzerland . | |
| 231377 | 6/1944 | Switzerland | 206/539 |
| 322103 | 7/1957 | Switzerland | 206/539 |
| 325705 | 12/1957 | Switzerland | 206/539 |
| 103968 | 2/1917 | United Kingdom . | |
| 407584 | 3/1934 | United Kingdom . | |
| 434334 | 8/1935 | United Kingdom . | |

*Primary Examiner*—David T. Fidei
*Attorney, Agent, or Firm*—Sughrue, Mion, Zinn, Macpeak & Seas

[57] ABSTRACT

A pack, namely a hinge-lid pack, for storing stick-shaped articles, such as cigarettes. A spacing within the pack separates a number of the stick-shaped articles from each other. The spacing includes a supporting member arranged between rows of the articles, and includes holding troughs or holding tongues for holding the articles in position. The holding tongues are formed by special punchings and foldings.

8 Claims, 8 Drawing Sheets

HINGE-LID PACK FOR STICK-SHAPED ARTICLES, ESPECIALLY CIGARETTES

BACKGROUND OF THE INVENTION

1. Field of the Invention

The invention relates to a hinge-lid pack for stick-shaped articles, such as cigarettes, with a pack part and a lid which is connected in an articulated manner to a rear wall of the pack part, and with a collar which is arranged in the pack part and of which the upper part projecting out of the pack part is surrounded by the lid in the closing position.

2. Description of the Related Art

Hinge-lid packs are a form of packaging for cigarettes and are in widespread use throughout the world. The cigarettes are arranged in rows within the pack. The hinge-lid pack consists of a pack part and of a lid which is connected to a rear wall of the pack part via a line of articulation. The hinge-lid pack usually consists of thin cardboard.

For specific stick-shaped elongate articles, especially for novel cigarettes or cigarette-like products, the hinge-lid pack admittedly continues to be a preferred form of packaging. However, the positioning of the cigarettes or the like within the pack is unsuitable for certain novel products in the previous form, because they are arranged close against one another.

SUMMARY OF THE INVENTION

The object on which the invention is based is to propose a pack, especially hinge-lid pack, for elongate, especially cylindrical articles, such as cigarettes or other comparable smoker's articles, in which the articles are positioned in a way corresponding to their properties.

To achieve this object, the hinge-lid pack according to the invention is defined by the following features:

a) the articles are arranged within the hinge-lid pack in a formation having at least two parallel rows, b) the articles are held in the pack part by a supporting member, in such a way that the articles are on all sides at a distance from one another and from side walls of the hinge-lid pack, c) the height of the supporting member is smaller than the height of the pack part.

The supporting member arranged according to the invention within the pack or within the pack part brings about an arrangement of the articles which is such that these are positioned at a clear distance from one another. The rows of articles are separated from one another by the carrying wall extending between these. The articles of each row are fixed at a distance from one another by the holding devices.

BRIEF DESCRIPTION OF THE DRAWINGS

The supporting members or insert pieces for the pack, which consist of the carrying wall and holding devices, can be designed in various ways, in order to position the cigarettes or the like on all sides at a distance from one another. Various exemplary embodiments are explained in more detail below by means of the drawings. In these.

DETAILED DESCRIPTION OF THE PREFERRED EMBODIMENTS

Figure 1:
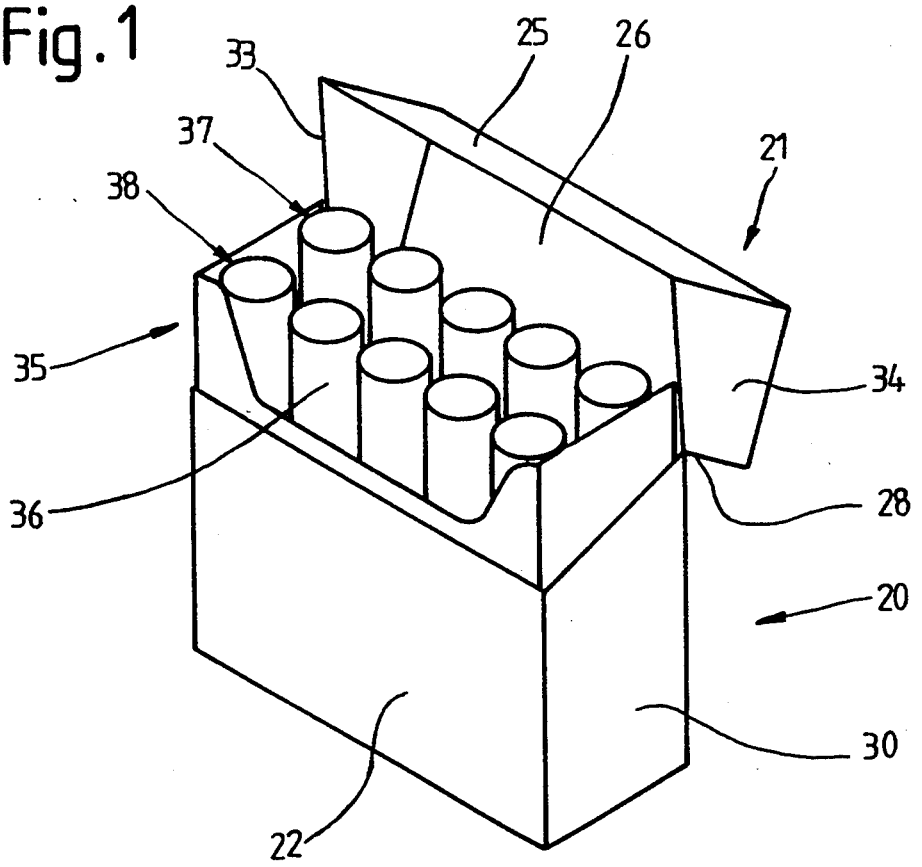
FIG. 1 shows a hinge-lid pack having cylindrical articles, with the lid opened, in a perspective representation.

The exemplary embodiments of packs or parts of these, illustrated in the drawings, relate to hinge-lid packs. This pack consists of a pack part 20 and of a lid 21. The pack part consists of a front wall 22, bottom wall 23 and rear wall 24.

The lid 21 similarly consists of a lid front wall 25, lid top wall 26 and lid rear wall 27. The latter is connected in one piece to the rear wall 22 via a line of articulation 28.

Side walls 29 and 30 of the pack part 20 consist of inner and outer side tabs 31 and 32. These overlap one another and are connected to one another by adhesive bonding. Lid side walls 33, 34 are designed correspondingly.

Within the pack part 20 is arranged a collar 35 of conventional design. This extends in the region of the front wall 22 and of the side walls 29, 30. The collar projects with a portion out of the pack part 20. The latter is surrounded by the lid 21 in the closing position.

The pack or hinge-lid pack serves for receiving elongate, in the present case cylindrical, articles 36. These can be (shorter) cigarettes or cigarette-like smoker's articles.

In the exemplary embodiment illustrated, the transverse dimensions of the hinge-lid pack correspond to those of conventional hinge-lid packs for cigarettes. Only the height of the hinge-lid pack is smaller. The articles 36 are positioned within the hinge-lid pack in two rows 37, 38, each row 37, 38 consisting here of five articles. These are arranged at a fixed invariable distance from one another within each row 37, 38 and from row to row, so that the possibility of mutual contact between the articles 36 is reliably prevented.

The positioning of the articles 36 within the pack, namely within the pack part 20, takes place by means of a supporting member 39. This is designed so that the articles 36 are positioned at distances from one another, but in aligned rows 37, 38. A supporting member consists respectively of at least one carrying wall or supporting wall and holding devices arranged on the latter and each intended for one article.

Figure 2:
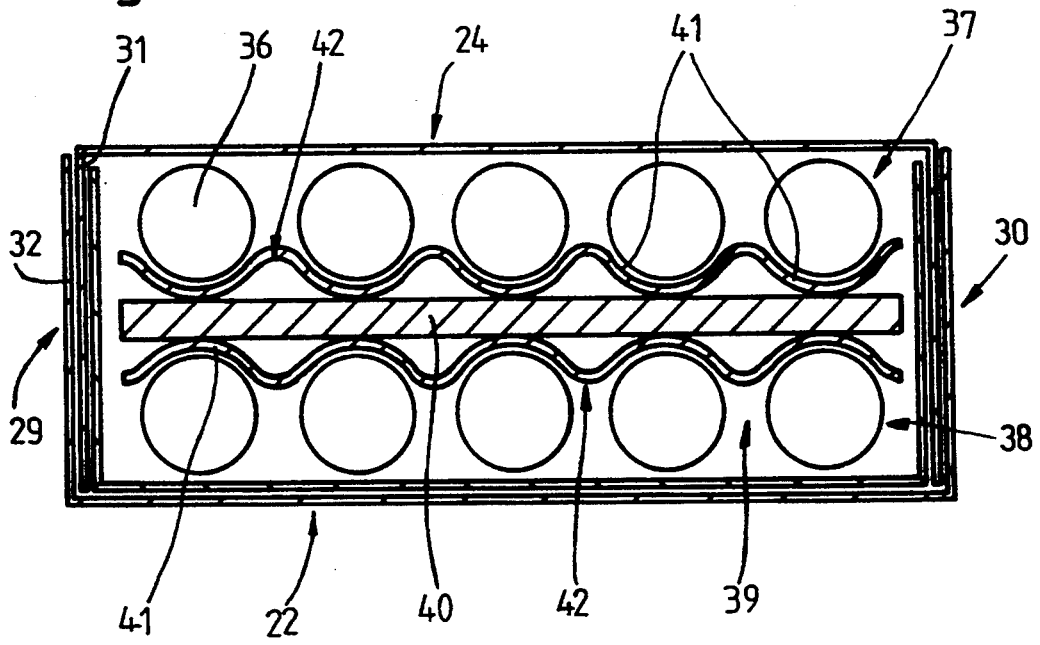
FIG. 2 shows a horizontal section through a pack according to FIG. 1 in the region of a pack part, on an enlarged scale.

In the exemplary embodiment of FIG. 2, a common upright carrying wall 40 is arranged centrally between the two rows 37, 38. The carrying wall 40 can consist of cardboard (corrugated cardboard), but also of another suitable material, for example foamed plastic or the like. Formed on the two free sides of the carrying wall 40, namely facing the articles 36, are trough-shaped holders for the articles 36, namely upright holding troughs 41. These are formed, here, from a wall 42 of wavy shape which can consist, for example, of a cardboard or of plastic. The wall 42 is connected to the common carrying wall 40, for example by adhesive bonding, in the region of the holding troughs 41 on the side remote from the articles 36. In this design, the supporting member 39 is preformed and is introduced into the pack during the packaging process, specifically preferably together with the articles 36 positioned in the holding troughs 41. On the free side, the articles 36 can bear on the front wall 22 or on the rear wall 24 of the pack part 20.

Figure 3:
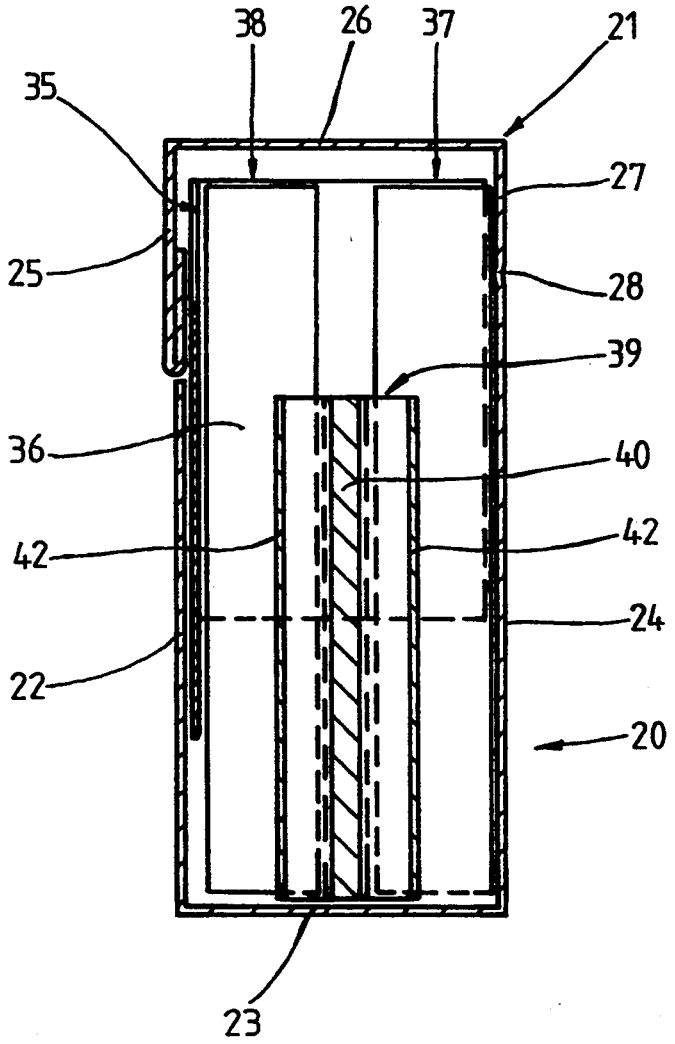
FIG. 3 shows a vertical section through the pack according to FIG. 1 and FIG. 2 in the closing position.

As is evident from FIG. 3, the supporting member 39 is arranged only in the region of the pack part 20. The supporting member 39 stands on the bottom wall 23. It can be positioned without special fixing. It is also possible, however, to connect the supporting member 39 to the bottom wall 23 and/or to the side walls 29, 30 by adhesive bonding or in another suitable way.

Figure 4:
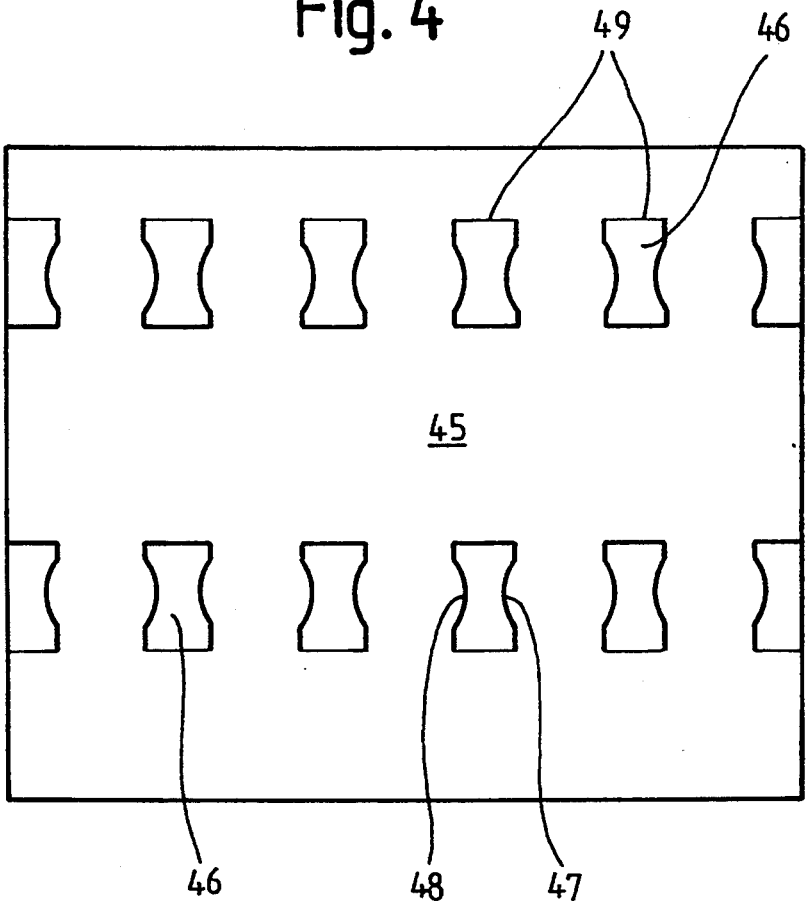
FIG. 4 shows a blank for a supporting member of a further exemplary embodiment of the pack, in projection.
Figure 5:
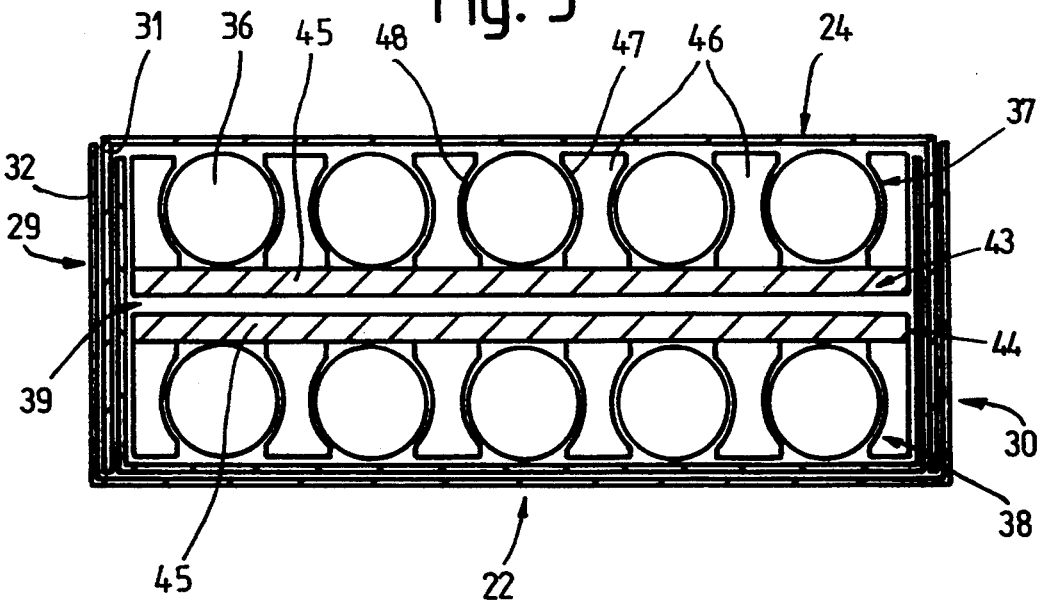
FIG. 5 shows a pack in a horizontal section corresponding to that of FIG. 2, with supporting members of FIG. 4.
Figure 6:
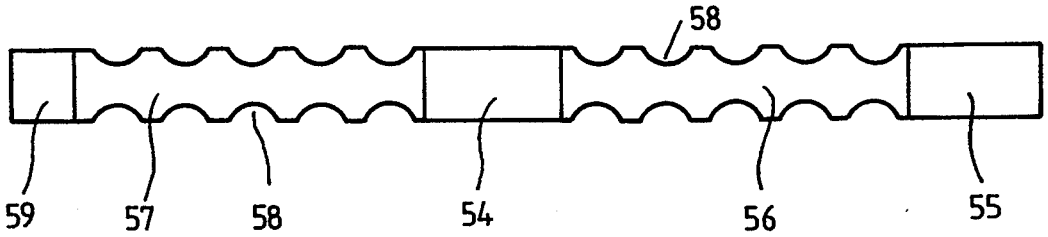
FIG. 6 shows a spread-out blank for a further example of a supporting member.
Figure 7:
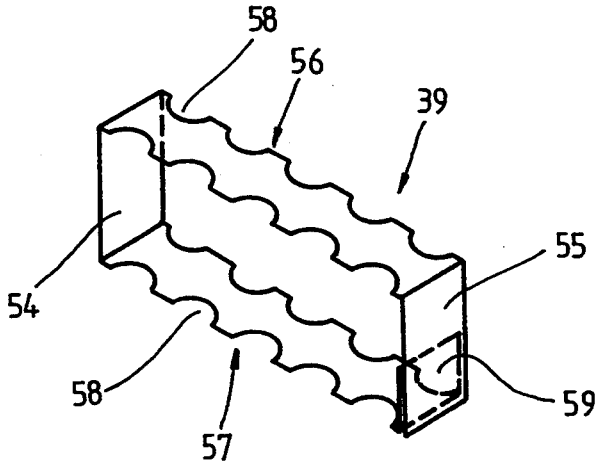
FIG. 7 shows a supporting member in the ready-folded form, in a perspective representation.
Figure 8:
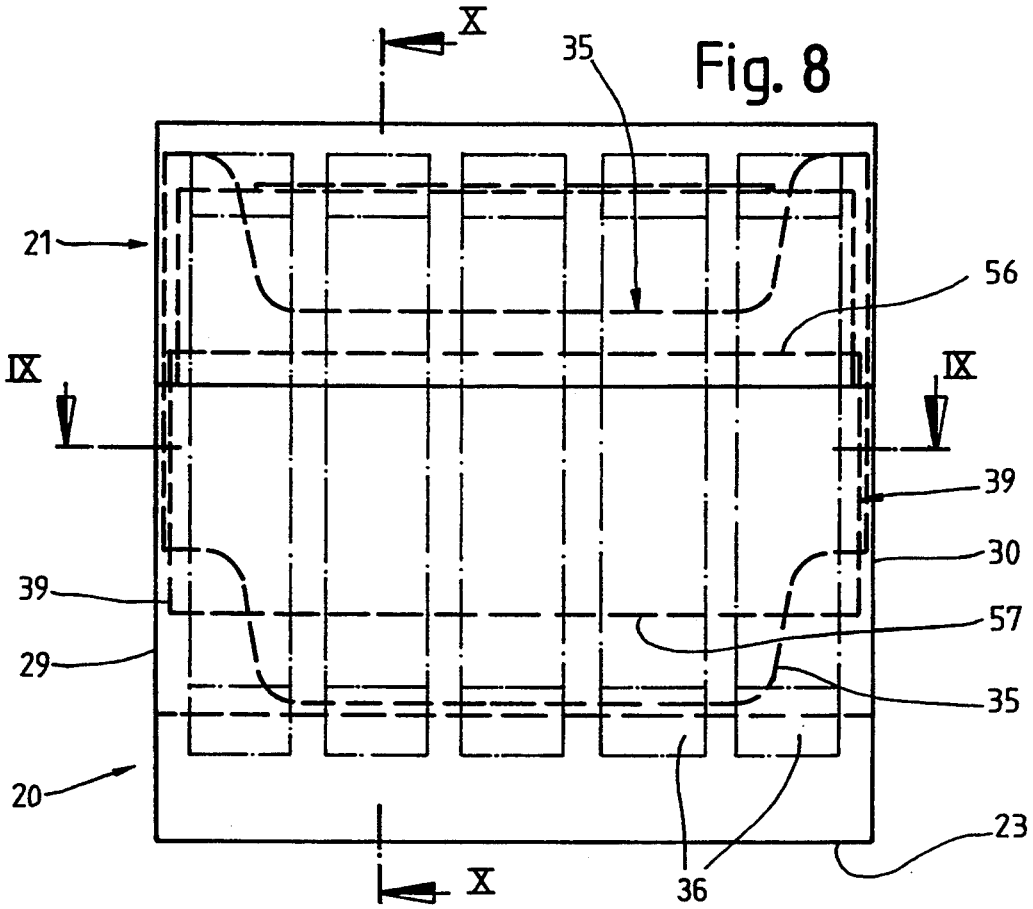
FIG. 8 shows a pack having a supporting member of FIG. 7 in a front view.
Figure 9:
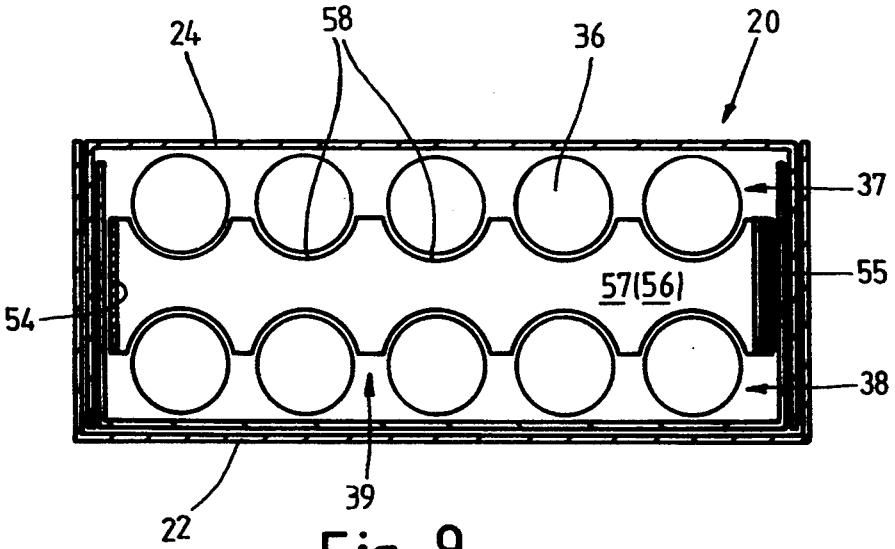
FIG. 9 shows a horizontal section through the pack according to FIG. 8 in the plane IX—IX.

In the exemplary embodiment according to FIG. 4 and FIG. 5, the supporting member 39 consists of two part members 43, 44 which are each assigned to a row 37, 38. Each part member 43, 44 consists of a carrying wall 45 and holding tongues 46 arranged on the latter on one side. In the present case, these extend respectively between adjacent articles 36 of a row 37, 38. The holding tongues 46 are provided on the mutually opposite sides with trough-shaped depressions 47, 48, in which the articles 36 rest positively with a part region of the circumference. Each article 36 is therefore partially surrounded by two mutually opposite holding tongues 46. The articles 36 are thereby also fixed in the direction of the front wall 22 or rear wall 24.

In the exemplary embodiment illustrated, the holding tongues 46 are shaped out of the carrying wall 45 (FIG. 4). This is provided with corresponding punchings, such that the holding tongues 46 remain connected to the carrying wall 45 in the region of a folding line 49. Moreover, the contour of the holding tongues 46 is defined by a corresponding punching cut. To form the supporting member 39, the holding tongues 46 are folded out of the plane of the carrying wall 45 into a holding position directed transversely to this (FIG. 5). The holding tongues 46 are pivoted through 90° about the folding line 49. Corresponding recesses remain in the carrying wall 45, but these do not impair its function.

The carrying walls 45 of the part members 43, 44 can be connected to one another or be held at a distance from one another in a suitable way. In this exemplary embodiment too, a unit consisting of the supporting member 39 together with the articles 36 is expediently introduced into the completely or partially folded hinge-lid pack.

The holding tongues 46 are arranged one above the other in two respective rows, so that the articles 36 are fixed by holding devices at two points arranged at a distance from one another in the longitudinal direction. The holding tongues 46 are positioned by punching in the carrying wall 45, in such a way that the folding line 49 is directed respectively upwards and downwards. Consequently, the holding tongues 46 of the upper row are moved upwards into the holding position by a pivoting movement and those of the lower row are moved downwards into the holding position by a pivoting movement.

In the exemplary embodiment according to FIGS. 6 to 10, a very simply designed supporting member 39 is used. It consists of an elongate strip-shaped blank (FIG. 6) made from thin cardboard or another suitable material. This blank is shaped into a three-dimensional form (FIG. 7) so as to produce lateral upright connecting webs 54, 55 and two supporting walls 56 and 57 arranged at a distance from one another in height. The supporting member 39 thus designed is arranged in the pack part 20 between the rows 37, 38 of articles 36, in such a way that the supporting walls 56, 57 extend transversely relative to the longitudinal axis of the articles 36. The articles 36 therefore bear with their outer surface on the supporting walls 56, 57. For exact positioning, the edge regions of the supporting walls 56, 57 facing the articles 36 are provided with trough-shaped recesses 58. The articles 36 rest positively in these with a part region of the circumference.

The supporting member 39 of the above-described version, formed from a blank, is provided at one end with a connecting flap 59 which is connected by adhesive bonding or sealing to the connecting web 55 formed on the opposite side, so that a stable three-dimensional member is obtained.

The supporting member 39 according to FIGS. 6 to 10 which is thus formed is, in the present case, positioned in the pack part 20 at a distance from the bottom wall 23. The upright connecting webs 54, 55 can be connected to the side walls 29, 30, namely to the inner side tabs 31, for example by adhesive bonding. An upper limitation of the supporting member, namely the upper supporting wall 56, extends at a distance below an upper edge of the collar 35.

Figure 10:
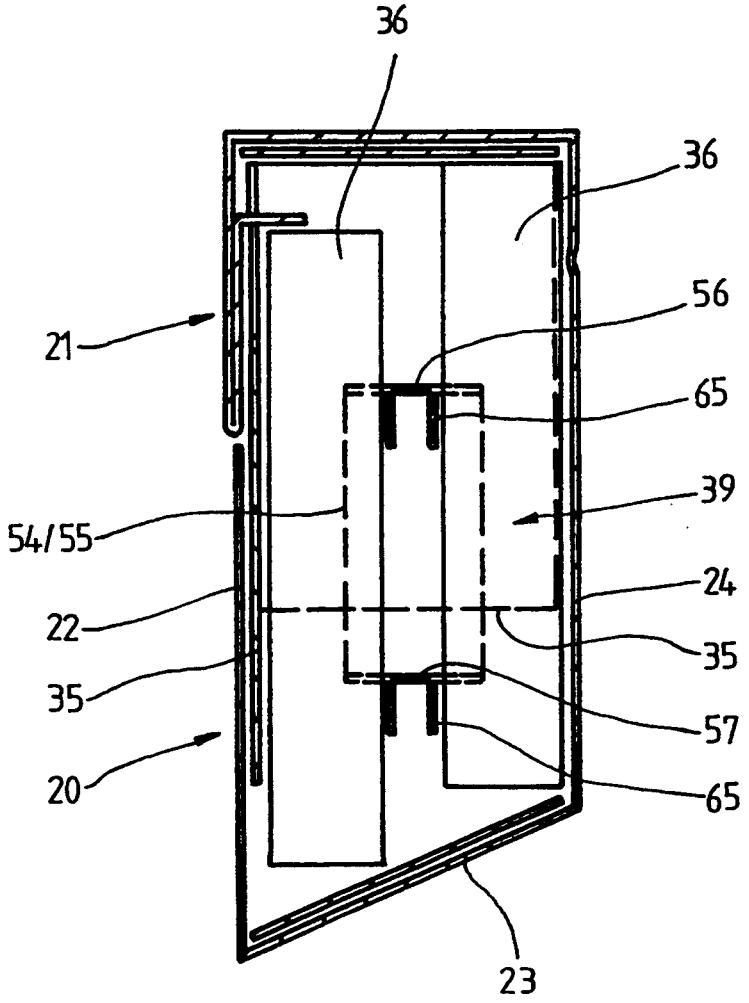
FIG. 10 shows a vertical section through the pack according to FIG. 8 in the sectional plane X—X of FIG. 8.

A special feature in the design of the pack, namely hinge-lid pack, with a supporting member 39 of this type, emerges from FIG. 10. The trough-shaped recesses 58 are formed by punching. Punched pieces 65 thereby obtained remain on the supporting member 39 via small or narrow residual connections. During the introduction of the articles 36 into the position appropriate for the pack, these punched pieces 45 are pivoted inwards into the region between the two rows 37, 38. Moreover, the recesses 58 are designed so that they surround the articles 36 along a part circumference which is somewhat smaller than half the circumference.

Figure 11:
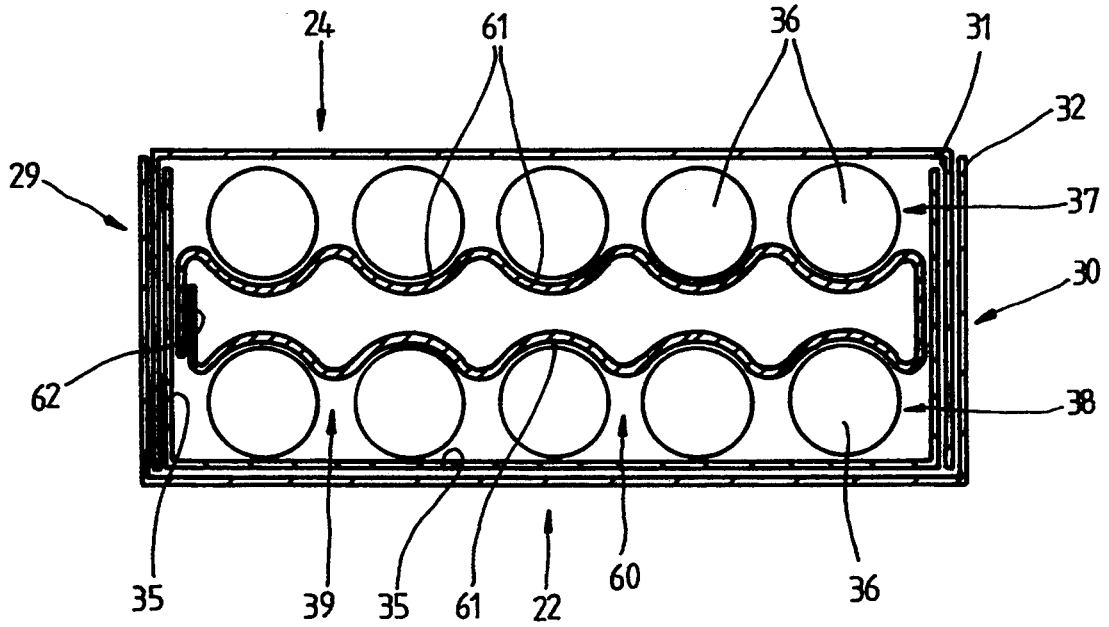
FIG. 11 shows a pack in horizontal section, with a further exemplary embodiment of a supporting member.

A supporting member 39, which is likewise simple in terms of production and material outlay, is shown in FIG. 11. It consists of a continuous upright carrying wall 60 which is of wavy shape as a whole, so that holding troughs 61 for the articles 36 are obtained. The carrying wall 60 or the entire supporting member 39 consists of a continuous material strip of wavy shape. Ends of the material strip are connected to one another in the region of an overlap 62, so that a closed hollow body positioned between the rows 37, 38 is obtained.

The holding troughs 61 are matched to the shape or to the dimension of the articles 36, so that these lie positively in the holding troughs. The supporting member 39 thus formed can extend over the entire height of the pack and, at the same time, stand on the bottom wall 23. It is also possible, however, to position the supporting member according to FIG. 11 at a distance from the bottom wall 23 by fastening to the side walls 29, 30 of the pack part 20, for example according to the exemplary embodiment of FIG. 10.

Figure 12:
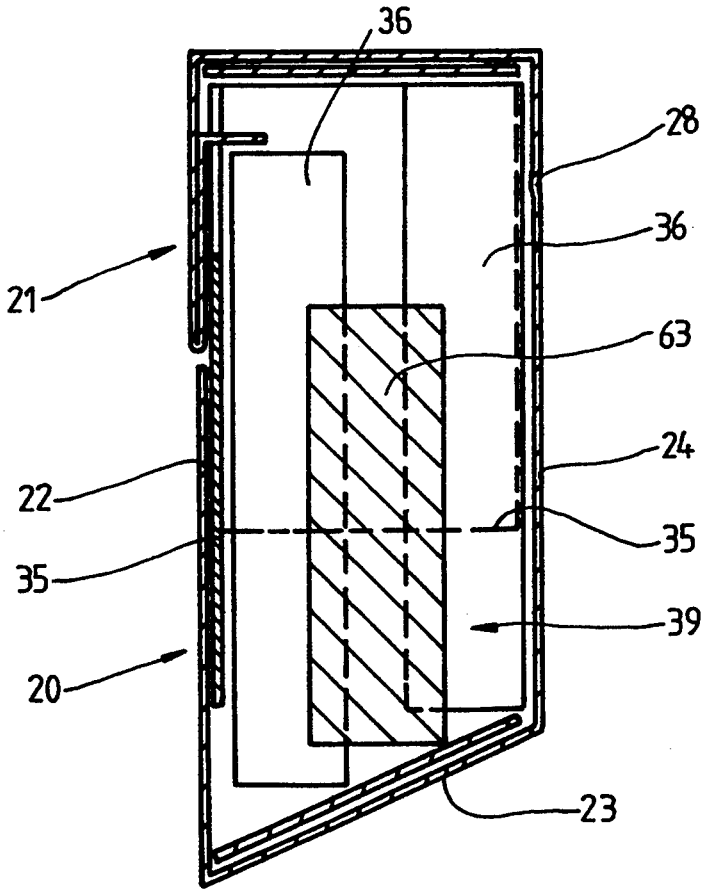
FIG. 12 shows a pack in vertical section, similar to FIG. 10, with a further embodiment of a supporting member.
Figure 13:
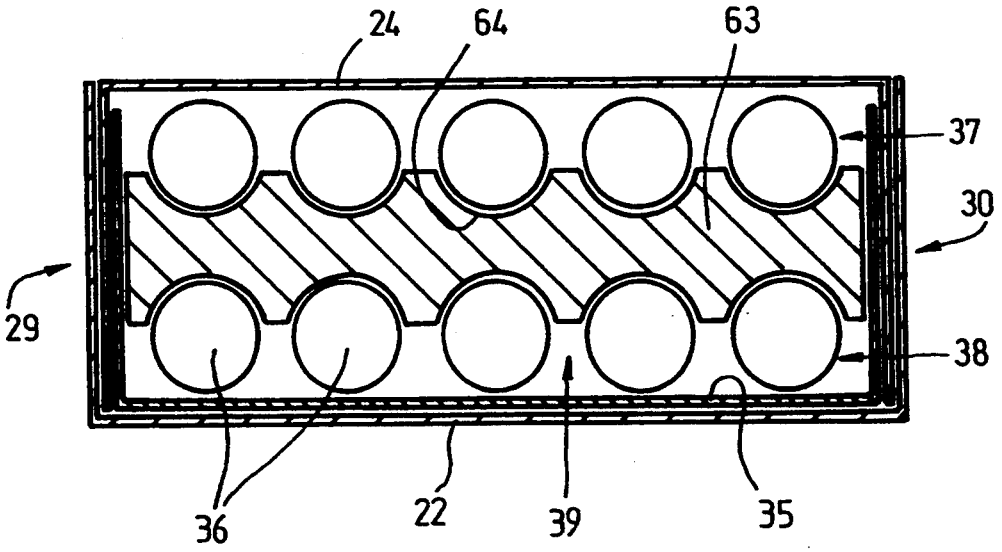
FIG. 13 shows the pack according to FIG. 12 in horizontal section in the region of the supporting member.

In the solution according to FIGS. 12 and 13, a unitary prefabricated moulding is arranged as a supporting member 39 between the rows 37, 38. The moulding can consist of plastic, especially foam, of cardboard (corrugated cardboard) or of another formable material. Arranged on both sides of a central carrying wall 63 are holding troughs 64 which serve for the positive reception of the articles 36. The holding troughs 64 can be formed during the production of the supporting member 39, for example in the case of supporting members consisting of foam. Where other materials are concerned, subsequent forming by embossing or other material deformation is possible, for example in the case of supporting members consisting of (thick) corrugated cardboard.

The supporting member according to FIGS. 12 and 13 extends as far as the bottom wall 23 and rests on the latter, as in the embodiment according to FIG. 11.

In all the exemplary embodiments, the pack can be equipped with a horizontal or transversely directed bottom wall 23, as in the exemplary embodiment of FIG. 3. However, an obliquely extending bottom wall can also be provided, as in the example according to FIG. 10 and FIG. 12. In this case, the two rows 37, 38 of the articles are arranged offset in height relative to one another as a result of the corresponding support on the obliquely directed bottom wall 23.

We claim:

1. A hinge-lid pack for stick-shaped articles, comprising:

a pack part (20) having side walls (29, 30) and a lid (21) which is connected in an articulated manner to a rear wall (24) of the pack part (20), and a collar (36) which is arranged in the pack part (20) and has an upper part projecting out of the pack part (20) which is surrounded by the lid (21) in the closing position, the articles (36) being arranged within the hinge-lid pack in a formation with at least two parallel rows (37, 38); and a supporting member (39) which holds the articles (36) in the pack part (20) in such a way that the articles (36) are on all sides at a distance from one another and from the side walls (29, 30) of the pack part, the height of the supporting member (39) being smaller than the height of the pack part (20);

the supporting member (39) comprising at least one upright carrying wall (40, 45, 60, 63) on which there are arranged on both sides holding devices for each article (36), wherein said holding devices face the articles (36), are shaped to match the contour of the articles (36) and are arranged at a distance from one another;

wherein the holding devices comprise holding tongues (46) which are formed out of the carrying wall (45), are connected to the carrying wall (45) by a folding line (49), and are folded through 90° about the folding line (49) into a horizontal position directed transversely to the carrying wall (45).

2. The hinge-lid pack as claimed in claim 1, wherein at least two rows of said holding tongues (46) arranged at a distance one above the other are arranged on the carrying wall (45), in such a way that each article (36) is grasped by at least two said holding tongues (46) arranged at a distance from one another.

3. The hinge lid pack as claimed in claim 1, wherein the articles (36) are fixed by said holding tongues (46) which are connected to the carrying wall (45) and which extend between adjacent articles (36) of a row (37, 38) and grasp these positively on two mutually opposite sides by corresponding depressions (47, 48).

4. A hinge-lid pack for stick-shaped articles, comprising:

a pack part (20) having side walls (29, 30) and a lid (21) which is connected in an articulated manner to a rear wall (24) of the pack part (20), and a collar (36) which is arranged in the pack part (20) and has an upper part projecting out of the pack part (20) which is surrounded by the lid (21) in the closing position, the articles (36) being arranged within the hinge-lid pack in a formation with at least two parallel rows (37, 38); and a supporting member (39), disposed between adjacent said rows (37, 38), which holds the articles (36) in the pack part (20) in such a way that the articles (36) are on all sides at a distance from one another and from the side walls (29, 30) of the pack part, the height of the supporting member (39) being smaller than the height of the pack part (20);

the supporting member (39) comprising at least two supporting walls (56, 57) which are arranged at a distance from one another in height and extend in a plane transverse to the longitudinal axis of the articles (36), and which have, at their free edges, trough-shaped recesses (58) for receiving a part of the articles (36).

5. The hinge-lid pack as claimed in claim 4, wherein the two supporting walls (56, 57) are part of a one-piece strip-shaped blank which is folded rectangularly and which is fastened in the pack part (20) at a distance from a bottom wall (23) of the latter.

6. A hinge-lid pack for stick-shaped articles, comprising:

a pack part (20) having side walls (29, 30) and a lid (21) which is connected in an articulated manner to a rear wall (24) of the pack part (20), and a collar (36) which is arranged in the pack part (20) and has an upper part projecting out of the pack part (20) which is surrounded by the lid (21) in the closing position, the articles (36) being arranged within the hinge-lid pack in a formation with at least two parallel rows (37, 38); and a supporting member (39) which holds the articles (36) in the pack part (20) in such a way that the articles (36) are on all sides at a distance from one another and from the side walls (29, 30) of the pack part, the height of the supporting member (39) being smaller than the height of the pack part (20);

the supporting member (39) comprising at least one upright carrying wall (40, 45, 60, 63) on which there are arranged on both sides holding devices for each article (36), wherein said holding devices face the articles (36), are shaped to match the contour of the articles (36) and are arranged at a distance from one another;

wherein the holding devices on at least one side of the carrying wall facing the articles (36) are holding troughs (41) corresponding to the contour of the articles (36) and comprising a wavy molding; and wherein the holding devices on at least one side of the carrying wall are holding tongues (46) which are formed out of the carrying wall, connected to the carrying wall by a folding line (49), and folded through 90° about the folding line (49) into a horizontal position directed transversely to the carrying wall (45).

7. A hinge-lid pack as claimed in claim 6, wherein at least two rows of said holding tongues (46) arranged at a distance one above the other are arranged on the carrying wall (45), in such a way that each article (36) is grasped by at least two said holding tongues (46) arranged at a distance from one another.

8. A hinge-lid pack as claimed in claim 6, wherein the articles (36) are fixed by said holding tongues (46) which are connected to the carrying wall (45) and which extend between adjacent articles (36) of a row (37, 38) and grasp the articles positively on two mutually opposite sides by corresponding depressions (47, 48).

* * * * *